US007563330B2

(12) United States Patent
Tsuji et al.

(10) Patent No.: US 7,563,330 B2
(45) Date of Patent: Jul. 21, 2009

(54) MAGNETIC MATERIAL AND MANUFACTURING METHOD THEREOF

(75) Inventors: Hideyuki Tsuji, Yokohama (JP); Akiko Saito, Kawasaki (JP); Tadahiko Kobayashi, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 348 days.

(21) Appl. No.: 11/414,302

(22) Filed: May 1, 2006

(65) Prior Publication Data

US 2006/0254385 A1 Nov. 16, 2006

(30) Foreign Application Priority Data

May 13, 2005 (JP) ..... P2005-141410

(51) Int. Cl.
*H01F 1/055* (2006.01)

(52) U.S. Cl. ..... 148/101; 148/301; 148/302

(58) Field of Classification Search ..... None
See application file for complete search history.

(56) References Cited

U.S. PATENT DOCUMENTS

| | | | | |
|---|---|---|---|---|
| 4,985,072 | A * | 1/1991 | Sahashi et al. | 75/246 |
| 6,676,772 | B2 | 1/2004 | Saito et al. | |
| 7,168,255 | B2 * | 1/2007 | Saito et al. | 62/3.1 |
| 2004/0079446 | A1 | 4/2004 | Kogure et al. | |
| 2004/0194855 | A1 | 10/2004 | Fukamichi et al. | |
| 2004/0231338 | A1 | 11/2004 | Saito et al. | |
| 2005/0000230 | A1 | 1/2005 | Saito et al. | |
| 2006/0231163 | A1 * | 10/2006 | Hirosawa et al. | 148/105 |
| 2006/0254385 | A1 | 11/2006 | Tsuji et al. | |

FOREIGN PATENT DOCUMENTS

| | | |
|---|---|---|
| DE | 103 38 467 A1 | 3/2004 |
| EP | 1 463 068 A2 | 9/2004 |
| JP | 2002-356748 | 12/2002 |
| JP | 2003-96547 | 4/2003 |

(Continued)

OTHER PUBLICATIONS

U.S. Appl. No. 12/015,812, filed Jan. 17, 2008, Tsuji, et al.

(Continued)

*Primary Examiner*—John P. Sheehan
(74) *Attorney, Agent, or Firm*—Oblon, Spivak, McClelland, Maier & Neustadt, P.C.

(57) ABSTRACT

A powder raw material is prepared by mixing at least two kinds of powders selected from a powder A, a powder B, a powder C, and a powder D. A sintered body of a magnetic material having an $NaZn_{13}$ crystal structure phase is formed by heating the powder raw material while applying a pressure treatment. The powder A is at least one of elemental powder of element R selected from Y, La, Ce, Pr, Nd, Sm, Eu, Gd, Tb, Dy, Ho, Er, Tm, and Yb. The powder B is at least one of elemental powder of element T selected from Fe, Co, Ni, Mn, and Cr. The powder C is at least one of elemental powder of element M selected from Si, B, C, Ge, Al, Ga, and In. The powder D is a compound powder composed of at least two kinds of elements selected from the element R, the element T, and the element M.

20 Claims, 6 Drawing Sheets

FOREIGN PATENT DOCUMENTS

| | | |
|---|---|---|
| JP | 2004-99928 | 4/2004 |
| JP | 2004-100043 | 4/2004 |
| JP | 2005-15911 | 1/2005 |
| JP | 2005-113270 | 4/2005 |
| JP | 2005-340838 | 12/2005 |

OTHER PUBLICATIONS

X.X. Zhang, et al. "Magnetic entropy change in Fe-based compound $LaFe_{10.6}Si_{2.4}$,", Applied Physics Letters, vol. 77, No. 19, Nov. 6, 2000, 3 Pages.

A. Yan, et al., "Structure and magnetic entropy change of melt-spun $LaFe_{11.57}Si_{1.43}$ ribbons", Journal of Applied Physics 97,036102, 2005, 3 pages.

O. Gutfleisch, et al., "Large magnetocaloric effect in melt-spun $LaFe_{13-x}Si_x$", Journal of Applied Physics 97, 10M305, 2005, 3 Pages.

U.S. Appl. No. 11/365,683, filed Mar. 2, 2006, Tsuji et al.

U.S. Appl. No. 11/414,302, filed May 1, 2006, Tsuji et al.

U.S. Appl. No. 11/385,726, filed Mar. 22, 2006, Kobayashi et al.

* cited by examiner

MAGNETIC MATERIAL AND MANUFACTURING METHOD THEREOF

CROSS-REFERENCE TO THE INVENTION

This application is based upon and claims the benefit of priority from the prior Japanese Patent Application No. 2005-141410, filed on May 13, 2005; the entire contents of which are incorporated herein by reference.

BACKGROUND OF THE INVENTION

1. Field of the Invention

The present invention relates to a manufacturing method of a magnetic material used for a magnetic refrigeration material, a magnetostrictive material, and so on, and to the magnetic material applying the method.

2. Description of the Related Art

In recent years, as an environment-conscious refrigeration technique, an expectation for a magnetic refrigeration which is clean and has a high energy efficiency is increasing. On the other hand, as a magnetic material for the magnetic refrigeration, a substance in which a large magnetic entropy change can be obtained near a room temperature is found. As such a magnetic substance for the magnetic refrigeration, (Hf, Ta)$Fe_2$, (Ti, Sc)$Fe_2$, (Nb, Mo)$Fe_2$, La(Fe, Si)$_{13}$ having an $NaZn_{13}$ type crystal structure, and so on are known.

Among these magnetic refrigeration substances, a substance represented by a chemical formula such as La(Fe, Si)$_{13}$, having the $NaZn_{13}$ type crystal structure is especially attracting attention. In such substance, Fe mainly enters into a position corresponding to Zn of a phase having the $NaZn_{13}$ type crystal structure (hereinafter, referred to as $NaZn_{13}$ crystal structure phase), and La mainly enters into a position corresponding to Na (hereinafter, this substance is abbreviated as $LaFe_{13}$ based magnetic material). In the $LaFe_{13}$ based magnetic material, the large magnetic entropy change can be obtained while a main constitutional element thereof is inexpensive Fe. Besides, it has a promising property as a practical magnetic refrigeration substance such that a temperature hysteresis does not occur in a magnetic phase transition (for example, refer to Japanese Patent Laid-open Application No. 2002-356748, and Japanese Patent Laid-open Application No. 2003-096547).

As a manufacturing method of the $LaFe_{13}$ based magnetic material, it is reported that a magnetic material whose main phase is the $NaZn_{13}$ crystal structure phase can be obtained by performing an integration of a raw material using an arc melting method and so on, and subsequently, by performing a heat treatment holding at 1000° C. for approximately a month (refer to X. X. Zhang et al., Appl. Phys. lett., Vol. 77, No. 19 (2000)). During a creating process of the $LaFe_{13}$ based magnetic material, a lot of α-Fe phases are included at a stage when the integration (alloying) of the raw material is performed by applying the arc melting method or a high frequency melting method, and the $NaZn_{13}$ crystal structure phase is rarely generated. Consequently, it is necessary to perform the heat treatment in high temperature and for a long time to obtain the $LaFe_{13}$ based magnetic material from the integrated alloy.

On the other hand, a generation of the α-Fe phase being a stable phase is suppressed and the $NaZn_{13}$ crystal structure phase is generated, by forcibly cooling a molten metal of the raw material composing the $LaFe_{13}$ based magnetic material at a cooling speed of approximately $1\times10^{4}$° C./s to solid, instead of naturally cooling the molten metal to solid. Incidentally, it is generally known that the cooling speed of an alloy molten metal is at approximately $1\times10^{2}$° C./s in the melting method represented by the high frequency melting or the arc melting, but a cooling can be performed at a speed of $1\times10^{4}$°C/s or more in a liquid quenching method represented by a cooling using a single-roll equipment. Here, the cooling at the speed of $1\times10^{4}$° C./s or more is expressed as a forced cooling.

For example, a method in which an alloy is formed by quenching (forced cooling) a raw material molten metal being the $LaFe_{13}$ based magnetic material whose main constituent is Fe, and a heat treatment is performed to this alloy at a temperature of 400° C. to 1200° C., is described in Japanese Patent Application Laid-open No. 2004-100043. A time for heat treatment can be reduced by applying such a method, but the main phase thereof is still the α-Fe phase even in an quenched alloy. Consequently, the heat treatment is inevitable to make the $NaZn_{13}$ crystal structure phase as a main phase. Further, when a quenched material in a thin-band state or a spherical state is grinded to be used as a particulate magnetic refrigeration material, there is a problem that a uniformity of composition between particles is lowered because many α-Fe phases are contained. In addition, the more there are the α-Fe phases, the more it becomes difficult to grind.

In Japanese Patent Laid-open Application No. 2004-099928, it is described that the $LaFe_{13}$ based magnetic material having the $NaZn_{13}$ crystal structure phase can be obtained just after a casting, by containing boron (B), carbon (C), and so on within a raw material composition of the $LaFe_{13}$ based magnetic material in the range of 1.8 atom percent to 5.4 atom percent. However, there is a problem that a compound phase containing B, for example, such as $F_2B$ phase exists as a hetero-phase in the alloy cast by this method, in accordance with an addition of B and so on to the raw material. A generation of the compound phase of Fe, B, and so on becomes a factor to deteriorate characteristics of the $LaFe_{13}$ based magnetic material.

As stated above, in the manufacturing process of the $LaFe_{13}$ based magnetic material useful as the magnetic refrigeration material and the magnetostrictive material, the heat treatment for a long time is required to obtain the $NaZn_{13}$ crystal structure phase, and therefore, there is a problem that a productivity thereof is extremely low caused by this long time heat treatment. Further, an oxygen amount within the material becomes relatively large, and magnetic characteristics of the $LaFe_{13}$ based magnetic material become easy to be lowered when the long time heat treatment is performed. It is difficult to completely eliminate the use of the heat treatment even when the $NaZn_{13}$ crystal structure phase is preferentially generated by applying the forced cooling. In addition, the material obtained by the forced cooling is in the spherical state or in the thin-band state, and therefore, there is a problem that a flexibility in shape is low.

SUMMARY OF THE INVENTION

The present invention may provide a manufacturing method of a magnetic material in which a manufacturing efficiency of the magnetic material having $NaZn_{13}$ crystal structure phase is increased, and characteristics of the magnetic material as a magnetic refrigeration material, a magnetostrictive material, and so on are improved according to an aspect of the present invention or embodiments consistent with the present invention.

A manufacturing method of a magnetic material according to an aspect of the present invention, including: preparing a powder raw material by mixing at least two of powders selected from a powder A, a powder B, a powder C, and a powder D, where the powder A is at least one selected from an elemental powder of element R, and the element R shows at least one selected from Y, La, Ce, Pr, Nd, Sm, Eu, Gd, Tb, Dy, Ho, Er, Tm, and Yb, the powder B is at least one selected from an elemental powder of element T, and the element T shows at least one selected from Fe, Co, Ni, Mn, and Cr, the powder C is at least one selected from an elemental powder of element M, and the element M shows at least one selected from Si, B, C, Ge, Al, Ga, and In, and the powder D is at least one selected from compound powders composed of at least two of elements among the element R, the element T, and the element M; and forming a sintered body of the magnetic material having an $NaZn_{13}$ crystal structure phase by heating the powder raw material while applying a-pressure.

A manufacturing method of a magnetic material according to another aspect of the present invention, including: preparing a master alloy by forcibly cooling a molten metal containing element R in a range of not less than 4 atom percent nor more than 15 atom percent, element T in a range of not less than 60 atom percent nor more than 93 atom percent, and element M in a range of not less than 3 atom percent nor more than 25 atom percent, where the element R shows at least one of element selected from Y, La, Ce, Pr, Nd, Sm, Eu, Gd, Tb, Dy, Ho, Er, Tm, and Yb, the element T shows at least one of element selected from Fe, Co, Ni, Mn, and Cr, and the element M shows at least one of element selected from Si, B, C, Ge, Al, Ga, and In; preparing an alloy powder by grinding the master alloy; and forming a sintered body of the magnetic material having an $NaZn_{13}$ crystal structure phase by heating the alloy powder while applying a pressure.

A magnetic refrigeration material according to an aspect of the present invention, including: a sintered body formed by applying the manufacturing method according to the aspect of the present invention.

A magnetic material according to an aspect of the present invention, including: a pulse current pressure sintered body having a composition represented by a general formula as stated below:

General formula: $R_xT_yM_z$ (In the formula, R is at least one of element selected from Y, La, Ce, Pr, Nd, Sm, Eu, Gd, Tb, Dy, Ho, Er, Tm, and Yb, T is at least one of element selected from Fe, Co, Ni, Mn, and Cr, M is at least one of element selected from Si, B, C, Ge, Al, Ga, and In, and x, y, and z represent numerals satisfying conditions as follows: 4 atom percent $\leqq x \leqq 15$ atom percent; 60 atom percent $\leqq y \leqq 93$ atom percent; 3 atom percent $\leqq z \leqq 25$ atom percent; and $x+y+z=100$), and including an $NaZn_{13}$ crystal structure phase as a main phase.

DESCRIPTION OF THE EMBODIMENTS

Figure 1:
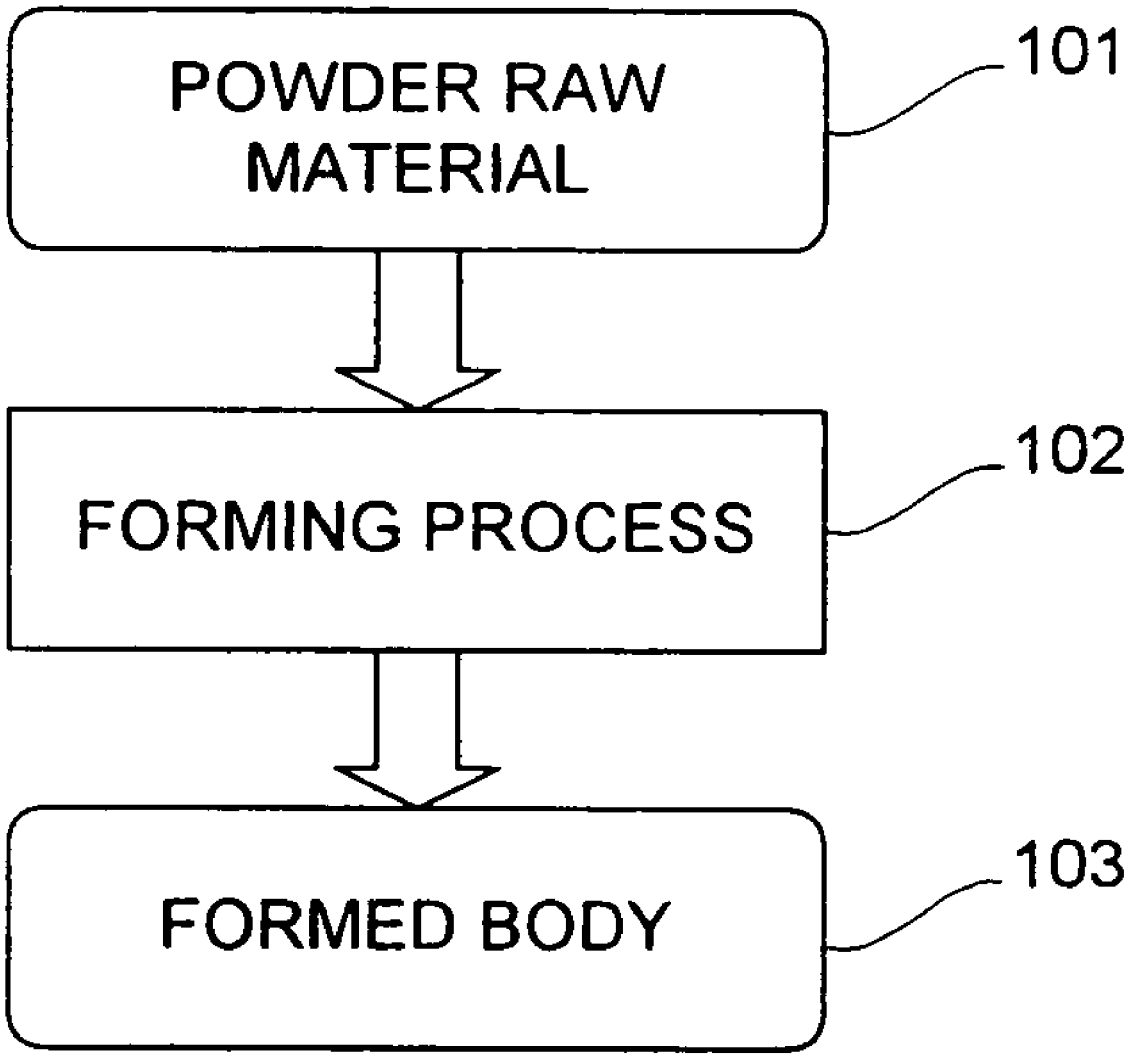
FIG. 1 is a process chart showing a manufacturing method of a magnetic material according to a first embodiment of the present invention.

Hereinafter, embodiments of the present invention are described. As shown FIG. 1, a manufacturing method of a magnetic material according to a first embodiment of the present invention includes a forming process 102 which heats a powder raw material 101 while a pressure treatment is applied, to thereby obtain a formed body 103 of the magnetic material whose main phase is the $NaZn_{13}$ crystal structure phase.

In the first embodiment, at first, the powder raw material 101 is prepared by mixing at least two kinds of powders selected from a powder A, a powder B, a powder C, and a powder D. Here, the powder A is at least one kind selected from an elemental powder of element R, and the element R is at least one kind of element selected from Y, La, Ce, Pr, Nd, Sm, Eu, Gd, Tb, Dy, Ho, Er, Tm, and Yb. The powder B is at least one kind selected from an elemental powder of element T, and the element T is at least one kind of element selected from Fe, Co, Ni, Mn, and Cr. The powder C is at least one kind selected from an elemental powder of element M, and the element M is at least one kind of element selected from Si, B, C, Ge, Al, Ga, and In. The powder D is at least one kind selected from compound powders composed of at least two kinds of elements among the element R, the element T, and the element M.

The powder raw material 101 is prepared by mixing the elemental powders of the respective elements and the compound powder composed of the respective elements composing a magnetic material. Herewith, a fine and uniform structure in accordance with particle sizes of the respective powders can be obtained. The powder raw material 101 is preferable to be prepared so as to contain the element R in the range of not less than 4 atom percent nor more than 15 atom percent, the element T in the range of not less than 60 atom percent-nor more than 93 atom percent, and the element M in the range of not less than 3 atom percent nor more than 25 atom percent.

In the magnetic material having the $NaZn_{13}$ crystal structure phase, the element R is mainly entered into a position corresponding to Na, and the element T and the element M are mainly entered into a position corresponding to Zn of the $NaZn_{13}$ crystal structure phase. The element R is preferable to be at least one kind selected from La, Pr, Ce, and Nd to enhance such characteristics of magnetic material as a magnetic refrigeration material and a magnetostrictive material. Fe, Co are preferable to be applied as the element T. The element M is preferable to be at least one kind selected from Si, Al, B, and Ge.

The respective powders composing the powder raw material 101 are not limited to the elemental powders of the respective elements, but the compound powder composed of the respective elements and the compound powder containing the respective elements (compound powder with the elements which do not badly affect on the characteristics and so on of the magnetic material) can be used. In an element having a high reactivity as an elemental substance, a mixed amount of an impurity element such as oxygen can be reduced by using the compound powder with other elements. For example, when La is used as the element R and Si is used as the element M, it is possible to use at least one kind of the compound powder selected from $La_5Si_3$, $La_3Si_2$, LaSi, and $LaSi_2$ as the powder containing La. It is the same as for the other element R.

It is preferable that the powder raw material 101 and the respective powders (powder A, powder B, powder C, powder D) composing it respectively have average particle sizes of 50 μm or less. Incidentally, the average particle sizes of the powder raw material 101 and the respective powders are measured by a particle size distribution measuring device "Mastersizer" made by Malvern Instruments Co. Ltd. If the average particle sizes of the powder raw material 101 and the respective powders are over 50 μm, the uniformity of the structure is lowered, and therefore, there is a possibility that a sintering efficiency in the forming process 102 deteriorates. Namely, the efficiencies of applying the pressure and the current heating in the forming process 102 are lowered, and thereby, there are possibilities that the characteristics of a formed body after sintered (sintered body of the magnetic material) 103 may deteriorate, and a cleavage and so on may occur in the formed body 103.

The smaller the average particle sizes of the powder raw material 101 are, the easier the generation of the $NaZn_{13}$ crystal structure phase is accelerated, but practically, it is possible to perform the sintering enough efficiently if the sizes are not less than 1 μm nor more than 50 μm. The powder raw material 101 with the average particle size of less than 1 μm is disadvantageous in handling, and there is a possibility to incur an increase of a manufacturing cost and so on. The average particle sizes of the powder raw material 101 and the respective powders composing it are preferable to be 20 μm or less.

The above-described raw material powders of the respective elements (powder A, powder B, powder C and powder D) are mixed to be a predetermined composition ratio. The mixing ratio of the respective powders (composition ratio of the powder raw material 101) is prepared to be as follows: the ratio of-the element R is in the range of not less than 4 atom percent nor more than 15 atom percent, the ratio of the element T is in the range of not less than 60 atom percent nor more than 93 atom percent, and the ratio of the element M is in the range of not less than 3 atom percent nor more than 25 atom percent. Herewith, it becomes possible to obtain the magnetic material showing distinguished characteristics as the magnetic refrigeration material and the magnetostrictive material. Concretely speaking, the magnetic material showing a large entropy change as the magnetic refrigeration material, and the magnetic material showing a large magnetostriction as the magnetostrictive material, can be obtained.

When the composition ratio of the element R is less than 4 atom percent or over 15 atom percent, the generation efficiency of the $NaZn_{13}$ crystal structure phase is lowered. The composition ratio of the element R is more preferable to be in the range of not less than 5 atom percent nor more than 10 atom percent. Similarly, when the composition ratio of the element T is less than 60 atom percent or over 93 atom percent, the generation efficiency of the $NaZn_{13}$ crystal structure phase is also lowered. The composition ratio of the element T is more preferable to be in the range of not less than 70 atom percent nor more than 91 atom percent. When the composition ratio of the element M is less than 3 atom percent, the generation efficiency of the $NaZn_{13}$ crystal structure phase is lowered, and when the composition ratio of the element M is over 25 atom percent, the characteristics of the magnetic material are lowered. The composition ratio of the element M is more preferable to be in the range of not less than 4 atom percent nor more than 20 atom percent. The $NaZn_{13}$ crystal structure phase of such a composition range shows a larger entropy change.

As the element R, it is preferable to use La, and the composition ratio at that time is preferable to be in the range of not less than 5 atom percent nor more than 10 atom percent. The element T is preferable to be Fe, and the composition ratio at that time is preferable to be in the range of not less than 70 atom percent nor more than 91 atom percent. In such a range, the larger entropy change is obtained such that the composition ratio of Fe is high. Therefore, the composition ratio of Fe is more preferable to be 79 atom percent or more. The element T may contain Co of not less than 0.5 atom percent nor more than 15 atom percent in addition to Fe. When the composition rate of Co is over 15 atom percent, a $LaCo_{13}$ compound generates and the amount of entropy change decreases. The element M is preferable to be Si, and the composition ratio at that time is preferable to be in the range of not less than 4 atom percent nor more than 20 atom percent. It becomes possible to enhance the characteristics of the magnetic material used as the magnetic refrigeration material and the magnetostrictive material by using the powder raw material 101 having such composition ratio.

Next, the forming process 102 in which the pressure and the heating are simultaneously applied to the powder raw material (mixture) 101 containing the element R, the element T, and the element M with the predetermined composition ratio, is performed. In the forming process 102, it is possible to apply the heating after the pressure is applied, but the generation efficiency of the $NaZn_{13}$ crystal structure phase is more improved by performing a current heating while the pressure treatment is applied because an active atomic diffusion occurs between the respective raw material particles. A similar phenomenon may also occur in a hot press method in which a heating corresponding to a normal heat treatment is performed while applying the pressure. The atomic diffusion between the raw material particles is easier to occur in the current heating treatment, and therefore, it is possible to obtain the $NaZn_{13}$ crystal structure phase in a short time.

In the forming process 102, for example, a pulse current is applied simultaneously with applying the pressure to the mixture. As a method to apply the pressure and the pulse current simultaneously, sintering methods called as a pulse current pressure sintering method and a spark plasma sintering method can be cited. According to the pulse current pressure sintering method, the pulse current is applied to the mixture (pressed powder body), and then, a rapid atomic diffusion may occur caused by a Joule heat generated between particles Further, the diffusion caused by an operation of an electric field may occur by applying the pulse current. A generation of an α-Fe phase is significantly suppressed by the rapid diffusion operation which comes from the heat and the electric field energy, and therefore, it becomes possible to generate the $NaZn_{13}$ crystal structure phase more stably. As a current applying method, a continuous current may be good, but the pulse current is more effective.

As a condition when the pulse current pressure sintering method is applied to the forming process 102, it is preferable that the pressure is applied to the mixture at 5 MPa to 100 Mpa under a vacuum condition or an inert gas atmosphere, and a direct pulse current with a voltage of 1 V to 20 V and a current per pressure-receiving area of 100 to 1300 $A/cm^2$ is flowed. According to the pulse current pressure sintering under such a condition, it is possible to sinter the mixture at a temperature of 800 to 1400° C. At this time, an effect can be obtained when a current applying time to the mixture is for one second or more, but more preferably, it is for one minute or more.

Further, the current applying time of not less than one minute nor more than one hour is preferable to be applied practically. It is enough to have the current applying time within one hour, and the generation efficiency of the $NaZn_{13}$ crystal structure phase is decreased gradually if it is performed for more than one hour.

According to the forming process 102 as stated above, a sintered body having a composition represented by a formula in the following and including the $NaZn_{13}$ crystal structure phase as a main phase, for example, a pulse current pressure sintered body can be obtained, based on the composition ratio of the powder raw material 101.

$$\text{General formula: } R_xT_yM_z \quad (1)$$

(In the formula, R shows at least one kind of element selected from Y, La, Ce, Pr, Nd, Sm, Eu, Gd, Tb, Dy, Ho, Er, Tm, and Yb, T shows at least one kind of element selected from Fe, Co, Ni, Mn, and Cr, M shows at least one kind of element selected from Si, B, C, Ge, Al, Ga, and In, and x, y, and z represent numerals satisfying conditions as follows: 4 atom percent $\leqq x \leqq 15$ atom percent; 60 atom percent $\leqq y \leqq 93$ atom percent; 3 atom percent $\leqq z \leqq 25$ atom percent; and $x+y+z=100$)

According to the forming process 102 applying the pressure and the current heating simultaneously, it is possible to obtain the formed body (sintered body of the magnetic material) 103 whose main phase is the $NaZn_{13}$ crystal structure phase in a short time without performing a long time heat treatment. Concretely speaking, the formed body 103 in which a generation ratio of the $NaZn_{13}$ crystal structure phase is 70% or more can be obtained. As concrete examples of the magnetic material having the formed body 103, a magnetic refrigeration material and a magnetostrictive material can be cited. The $NaZn_{13}$ crystal structure phase is also generated by the hot press method, an ultra high pressure sintering method, an HIP method, and so on, in which the pressure and the heating are applied simultaneously, but the generation efficiency thereof is the highest in the pulse current pressure sintering method. Further, the forming process 102 is excellent in an operationality and a simplicity, and the method can be said to be effective and practical.

As stated above, it becomes possible to directly obtain the magnetic material whose main phase is the $NaZn_{13}$ crystal structure phase, namely, the sintered body having the composition represented by the above-stated formula (1), and having the $NaZn_{13}$ crystal structure phase as the main phase from the respective raw material powders (elemental powders and compound powder) of the element R, the element T, and the element M by applying the forming process 102 in which the pressure and the current are simultaneously applied. Further, the generation ratio of the $NaZn_{13}$ crystal structure phase can be increased. Consequently, the manufacturing efficiency of the magnetic material showing excellent characteristics as the magnetic refrigeration material and the magnetostrictive material can be increased.

Incidentally, when only physical property values such as an entropy change as the magnetic refrigeration material and a magnetostriction as the magnetostrictive material are considered, it is ideal to approximate the ratio of the $NaZn_{13}$ crystal structure phase to 100% more and more. However, an intensity, a thermal conductivity, and so on being practical characteristics of the magnetic material can be adjusted by containing a small amount of second phase (for example, the $\alpha$-Fe phase). Consequently, the formed body 103 is good enough if the $NaZn_{13}$ crystal structure phase is the main phase thereof, and a small amount of second phase may be contained.

Further, the characteristics as the magnetic refrigeration material and the magnetostrictive material in themselves can be enhanced because the crystal particle size of the magnetic material created by applying the forming process 102 is miniaturized. A reduction of an oxygen content also contributes to an improvement of the characteristics of the magnetic material. Namely, the forming process 102 is performed, in which the pressure and the current heating are applied to the mixture of the respective raw material powders simultaneously , and thereby, a long time heat treatment is not necessary to be performed, and the oxygen amount within the magnetic material can be reduced. The oxygen content within the magnetic material is preferable to be suppressed within 2 atom percent or less, and more preferably, it is suppressed to be 0.2 atom percent or less.

The manufacturing method according to the first embodiment contributes to the increase of the characteristics as the magnetic refrigeration material and the magnetostrictive material, in addition to the enhancement of the manufacturing efficiency of the magnetic material having the $NaZn_{13}$ crystal structure phase. Incidentally, the manufacturing method of the magnetic material according to the first embodiment is not necessarily excluded the heat treatment after the forming process 102. The characteristics of the magnetic material can be increased further more without deteriorate the manufacturing efficiency, if the heat treatment is within a short time.

Besides, it is effective to make the magnetic material contain hydrogen by performing the heat treatment to the formed body 103 under a hydrogen atmosphere. Herewith, it becomes possible to increase a temperature range in which a large magnetic entropy change and a large magnetostriction can be obtained, and further, it is possible to make such temperature range near a room temperature. A hydrogen content of the magnetic material is preferable to be in the range of not less than 2 atom percent nor more than 22 atom percent. A shape of the formed body 103 is not limited especially, and it can be a plate state, a spherical state, a reticulate state, and so on. Further, a process can be performed for the formed body 103 to obtain a desired-shaped magnetic material.

Figure 2:
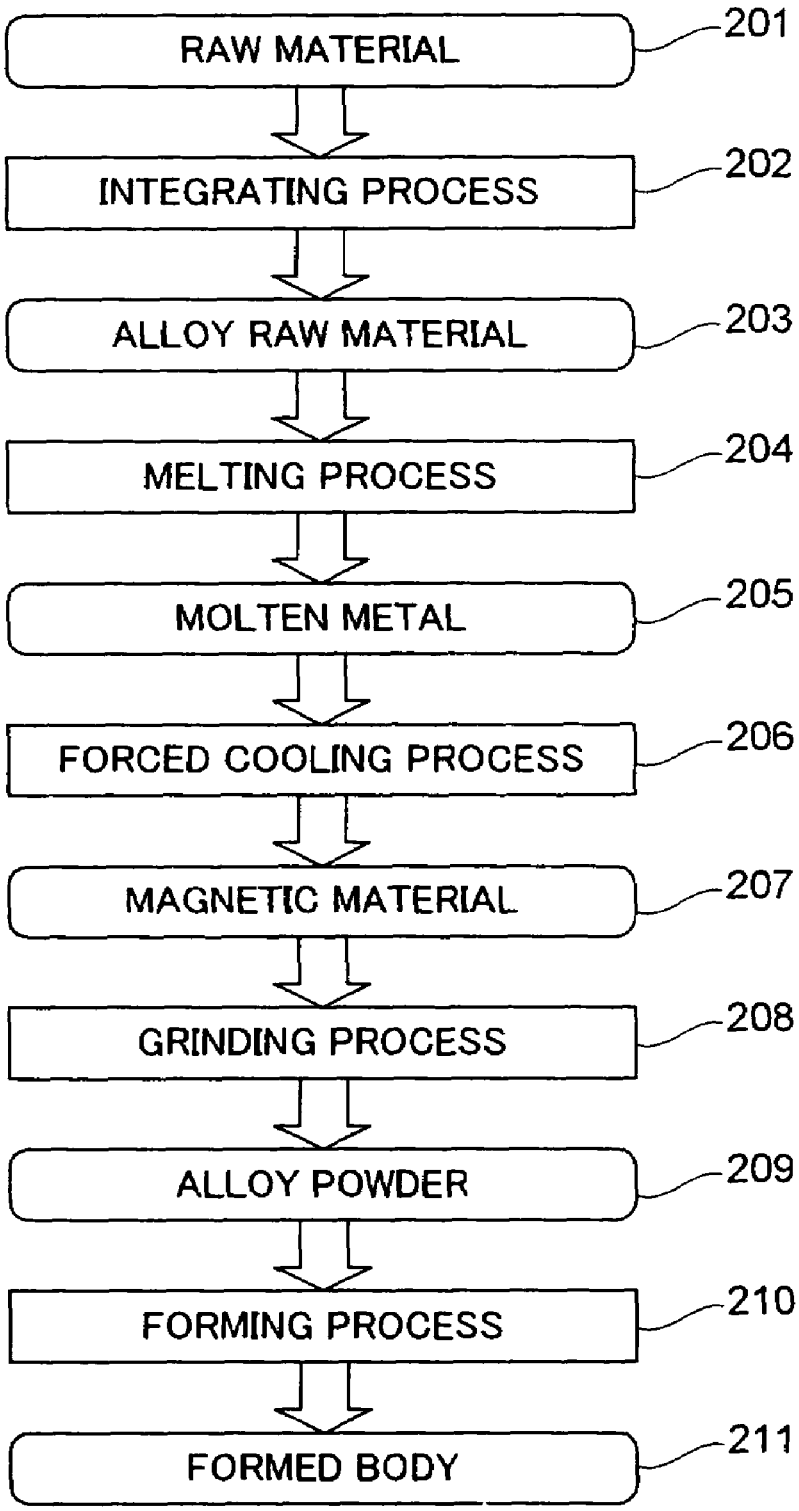
FIG. 2 is a process chart showing a manufacturing method of a magnetic material according to a second embodiment of the present invention.

Next, a manufacturing method of a magnetic material according to a second embodiment of the present invention is described with reference to FIG. 2. The manufacturing method according to the second embodiment includes a process 202 integrating (alloying) a raw material 201 of the magnetic material, a process 204 melting an integrated alloy raw material 203, a process 206 forcibly cooling a molten metal 205, a process 208 grinding a magnetic material (master alloy) 207 obtained by the forced cooling, and a forming process 210 applying a pressure and a heating to a grinded alloy powder 209, to thereby obtain a formed body 211 of the magnetic material whose main phase is an $NaZn_{13}$ crystal structure phase.

In the second embodiment, at first, the raw material 201 in which a ratio of an element R is in the range of not less than 4 atom percent nor more than 15 atom percent, a ratio of an element T is in the range of not less than 60 atom percent nor more than 93 atom percent, and a ratio of an element M is in the range of not less than 3 atom percent nor more than 25 atom percent, is prepared. As the raw material 201, at least two kinds of substances selected from a substance A, a substance B, a substance C, and a substance D shown in the following, are used.

The substance A is one kind or two kinds or more of elementary substance(s) of at least one kind of element R selected from Y, La, Ce, Pr, Nd, Sm, Eu, Gd, Tb, Dy, Ho, Er, Tm, and Yb. The substance B is one kind or two kinds or more of elementary substance(s) of at least one kind of element T selected from Fe, Co, Ni, Mn, and Cr. The substance C is one kind or two kinds or more of elementary substance(s) of at least one kind of element M selected from Si, B, C, Ge, Al, Ga, and In. The substance D is one kind or two kinds or more of compound(s) composed of at least two kinds of elements selected from the element R, the element T, and the element M.

Next, the raw material 201 is integrated (alloyed) by applying an arc melting method, a high-frequency melting method, or the like (process 202). Further, the integrated alloy raw material 203 is melted (process 204), to prepare the molten metal 205 used at the forced cooling process. As stated above, a uniformity of the molten metal 205 can be increased by melting the raw material 201 once, and then alloyed. However, in the integrating process 202, other methods can be applied without limiting to the melting methods such as the arc melting method, the high-frequency melting method, and so on, because it is enough that the uniformity of the molten metal 205 used at the forced cooling process 206 can be secured. Further, if an uniform molten metal 205 can be obtained in the melting process 204 in itself, the integrating process 202 in itself can be omitted. Namely, the melting process 204 can be performed directly by using the raw material 201.

A composition ratio of the molten metal 205 created in the melting process 204, is adjusted so that the ratio of the element R is in the range of not less than 4 atom percent nor more than 15 atom percent, the ratio of the element T is in the range of not less than 60 atom percent nor more than 93 atom percent, and the ratio of the element M is in the range of not less than 3 atom percent nor more than 25 atom percent. The composition ratio of these respective elements are to be in the above-stated respective ranges so as to enhance a generation efficiency of an $NaZn_{13}$ crystal structure phase and characteristics of the magnetic material, as same as in the first embodiment. It is more preferable that the composition ratio of the element R is in the range of not less than 5 atom percent nor more than 10 atom percent, the composition ratio of the element T is in the range of not less than 70 atom percent nor more than 91 atom percent, and the composition ratio of the element M is in the range of not less than 4 atom percent nor more than 20 atom percent.

As the element R, La is preferable to be used, and the composition ratio at that time is preferable to be in the range of not less than 5 atom percent nor more than 10 atom percent. The element T is preferable to be Fe, and the composition ratio at that time is preferable to be in the range of not less than 70 atom percent nor more than 91 atom percent. In such a range, the larger entropy change is obtained such that the composition ratio of Fe is high. Therefore, the composition ratio of Fe is more preferable to be 79 atom percent or more. The element T may contain Co of not less than 0.5 atom percent nor more than 15 atom percent in addition to Fe. The element M is preferable to be Si, and the composition ratio at that time is preferable to be in the range of not less than 4 atom percent nor more than 20 atom percent.

Next, the molten metal 205 is forcibly cooled (process 206), to prepare the magnetic material 207 to be the master alloy. A structure (alloy structure) is miniaturized at this time, and therefore, it becomes possible to accelerate a generation of the $NaZn_{13}$ crystal structure phase within the final magnetic material. A cooling speed of the molten metal 205 in the forced cooling process 206 is preferable to be at $1\times10^{4}$° C./s or more. When the cooling speed of the molten metal 205 is from $1\times10^{2}$ to $1\times10^{3}$° C./s, the generation of the α-Fe phase is given priority over the generation of other phases, and therefore, a miniaturization effect of the structure by the cooling can not be obtained sufficiently.

It is possible to miniaturize the alloy structure by setting the cooling speed of the molten metal 205 to be $1\times10^{4}$° C./s or more. Further, the generation of the α-Fe phase being a stable phase is suppressed, and the $NaZn_{13}$ crystal structure phase can be formed stably. The faster the cooling speed of the molten metal 205 in the forced cooling process 206 is, the more the generation of the α-Fe phase is suppressed, and the generation of the $NaZn_{13}$ crystal structure phase is given priority. The miniaturizing effect of the structure also increases. Consequently, the cooling speed of the molten metal 205 is more preferable to be $1\times10^{5}$° C./s or more. Such effect is maintained when the cooling speed is $1\times10^{8}$° C./s.

The forced cooling process 206 may be performed by any method as long as the cooling speed as stated above can be realized, and the cooling method in itself is not especially limited. As a quenching method of the molten metal 205 to realize the forced cooling, for example, a water atomizing method, a gas atomizing method, a centrifugal atomizing method, a plasma atomizing method, a rotational electrode method, an RDP method, a single-roll quenching method, a twin-roll quenching method, and so on can be cited. Among these methods, when the single-roll quenching method and the twin-roll quenching method are used, it is possible to perform a high-speed forced cooling in a well controlled state by selecting a discharge amount of the molten metal 205, a peripheral speed of the roll, an atmosphere, and so on appropriately.

In the water atomizing method, the gas atomizing method, the centrifugal atomizing method, the plasma atomizing method, the rotational electrode method, and the RDP method, it is possible to realize a high cooling speed by reducing an obtained particle size. For example, the particle size is made to be 100 μm or less, and then, the cooling speed of $1\times10^{4}$° C./s or more can be obtained. When the roll quenching method is applied in the forced cooling process 206, an average thickness of an obtained alloy thin-band is preferable to be in the range of 10 to 100 μm. When the average thickness of the alloy thin-band is over 100 μm, there is a possibility that a sufficient cooling speed is not obtained all over a sample. Consequently, it is preferable that the average thickness is smaller, but the sufficient cooling effect can be obtained if it is in the range of 10 to 100 μm. More preferably, it is in the range of 10 to 50 μm.

Next, the master alloy (magnetic material 207) prepared in the forced cooling process 206 is grinded (process 208), to prepare the alloy powder 209 to be the powder raw material of the forming process 210. The master alloy (magnetic material 207) is preferable to be grinded so that the average particle size is 50 μm or less. If the average particle size of the alloy powder 209 is over 50 μm, the uniformity of the structure is lowered, to thereby lower the efficiencies of the pressure and the heating in the forming process 210, and there is a possibility that a cleavage and so on may occur on the formed body 211.

The smaller the average particle size of the alloy powder 209 is, the more the generation of the $NaZn_{13}$ crystal structure phase is accelerated, but practically, the sintering process can be performed enough efficiently if it is not less than 1 μm nor more than 50 μm. The average particle size of the alloy powder 209 is more preferable to be 20 μm or less. Incidentally, when the average particle size of the master alloy (magnetic material 207) prepared in the forced cooling process 206 satisfies a desired average particle size (for example, 50 μm or less) without being grinded, it goes without saying that the grinding process 208 is not necessary.

Next, the forming process 210 is performed, in which the above-stated alloy powder 209 is heated while applying the pressure. In the forming process 210, a heating corresponding to a normal heat treatment may be performed while applying the pressure, or the current heating may be performed while applying the pressure as same as the first embodiment. The pressure and the current heating are simultaneously applied in the forming process 210, and thereby, the generation of the $NaZn_{13}$ crystal structure phase is accelerated. A similar effect can also be obtained by a hot press method and so on in which the heating corresponding to the normal heat treatment is performed while applying the pressure, but an atomic diffusion between the raw material particles occur easier in the current heating, and therefore, the $NaZn_{13}$ crystal structure phase is generated in a relatively short time, and the magnetic material (formed body 211) can be obtained efficiently.

The forming process 210 is preferable to be a process in which the pressure and the pulse current are simultaneously applied to the alloy powder 209. As such a method, sintering methods called as the pulse current pressure sintering method and the spark plasma sintering method as stated above can be cited. According to the pulse current pressure sintering method, the $NaZn_{13}$ crystal structure phase can be generated stably in a shorter time.

As a condition when the pulse current pressure sintering method is applied in the forming process 210, it is preferable to flow a direct pulse current with a voltage of 1 V to 20 V and a current per pressure-receiving area of 100 to 1300 A/cm$^2$ while applying the pressure to the mixture at 5 MPa to 100 MPa under a vacuum state or an inert gas atmosphere. According to the pulse current pressure sintering under such condition, the above-stated alloy powder can be sintered at a temperature of 800 to 1400 ° C. At this time, the effect can be obtained if a time for applying the current to the alloy powder is for one second or more, but more preferably, it is for one minute or more. Further, practically, it is preferable to apply the current applying time for not less than one minute nor more than one hour. The current applying time within one hour is enough, and the generation efficiency of the $NaZn_{13}$ crystal structure phase is gradually lowered if the time is more than one hour.

According to the above-stated forming process 210, a sintered body having the composition represented by the above-stated formula (1), including the $NaZn_{13}$ crystal structure phase as the main phase, based on the composition ratio of the molten metal 205, for example, a pulse current pressure sintered body can be obtained. According to the forming process 210, it is possible to obtain the formed body (sintered body of the magnetic material) 211 whose main phase is the $NaZn_{13}$ crystal structure phase in a short time without performing the heat treatment for a long time. For example, it is possible to obtain the formed body 211 in which the generation ratio of the $NaZn_{13}$ crystal structure phase is 95% or more. The $NaZn_{13}$ crystal structure phase is also generated by the hot press method, the ultra high pressure sintering method, the HIP method, and so on, but the pulse current pressure sintering method is excellent in operationality and simplicity, and the sintering in a short time such as in a few minutes is possible.

As stated above, the generation ratio of the $NaZn_{13}$ crystal structure phase can be increased in a short time and efficiently by applying the forming process 210 in which the pressure and the heating (especially the current heating) are applied simultaneously. Consequently, it becomes possible to enhance the manufacturing efficiency of the magnetic material showing excellent characteristics as the magnetic refrigeration material and the magnetostrictive material. Incidentally, when only physical property values such as the entropy change as the magnetic refrigeration material and the magnetostriction as the magnetostrictive material are considered, it is ideal to approximate the ratio of the $NaZn_{13}$ crystal structure phase to 100% more and more, but it becomes possible to enhance an intensity, a thermal conductivity, and so on being practical characteristics of the magnetic material, by containing a small amount of second phase (for example, the α-Fe phase). Consequently, the formed body 211 may contain a small amount of second phase.

Further, in the magnetic material created by applying the forming process 210, a crystal particle size is miniaturized based on a fine structure and so on of the master alloy, and therefore, the characteristics as the magnetic refrigeration material and the magnetostrictive material in themselves can be enhanced. A reduction of the oxygen content and so on also contribute to the characteristics improvement of the magnetic material. Namely, the oxygen amount within the magnetic material can be reduced by shortening the time and so on of the forming process 210. The oxygen content within the magnetic material is preferable to be suppressed within 2 atom percent or less, and further, it is desirable to make it within 0.2 atom percent or less.

The manufacturing method according to the second embodiment increases the manufacturing efficiency of the magnetic material having the $NaZn_{13}$ crystal structure phase, and in addition, contributes to the improvement of the characteristics as the magnetic refrigeration material and the magnetostrictive material. Incidentally, the manufacturing method of the magnetic material according to the second embodiment does not necessarily exclude the heat treatment after the forming process 210. The characteristics of the magnetic material can further be enhanced without lowering the manufacturing efficiency, if the heat treatment is within a short time.

It is also effective that the formed body 211 is performed the heat treatment under the hydrogen atmosphere, to thereby make the magnetic material contain hydrogen. Herewith, it is possible to increased a temperature zone in which the large magnetic entropy change and the large magnetostriction can be obtained, and further, such temperature zone can be adjusted to be near a room temperature. The hydrogen content of the magnetic material is preferable to be in the range of not less than 2 atom percent nor more than 22 atom percent. A shape of the formed body 211 is not especially limited, and it may be a plate state, a spherical state, a reticulate state, and so on. A process for the formed body 211 may be performed to obtain the magnetic material in a desired shape.

Next, concrete examples and evaluation results of the present invention are described.

EXAMPLE 1

At first, LaSi powder with an average particle size of a 10 μm, Fe powder with the average particle size of a 6 μm, and Si powder with the average particle size of a 7 μm are prepared, and these are blended so as to be a stoichiometry of $La(Fe_{0.88}Si_{0.12})_{13}$. Further, they are mixed and miniaturized so that the average particle size of the mixture becomes to be 5 μm. A composition ratio of respective elements within the mixed powder (powder raw material) is as follows: La is approximately 7.2 at. %; Fe is approximately 81.7 at. %; and Si is approximately 11.1 at. %.

Next, the miniaturized mixed powder (powder raw material) is sintered by using a pulse current pressure sintering equipment. The sintering is performed under a condition that a degree of vacuum within a chamber is 2 Pa, and a direct pulse current with a maximum voltage of 3.2 V, and a maximum current per pressure-receiving area of 500 A/cm$^2$ is flowed while a sample is applied a pressure of 40 MPa. As a pulse condition, an ON-OFF period of a pulse current is set to be 12-2. A sintering temperature is approximately 1000° C., and the state is kept for 10 minutes.

EXAMPLE 2

After the respective powders of LaSi, Fe, Co, Si are mixed to be $La(Fe_{0.83}Co_{0.05}Si_{0.12})_{13}$, the pulse current pressure sintering is performed under the same condition with Example 1. The composition ratio of the respective elements within the mixture to be a raw material is as follows: La is approximately 7.2 at. %; Fe is approximately 77.1 at. %; Co is approximately 4.6 at. %; and Si is approximately 11.1 at. %.

EXAMPLE 3

After the respective powders of LaSi, Fe, Co, Si are mixed to be $La(Fe_{0.88}Co_{0.03}Si_{0.09})_{13}$, the pulse current pressure sintering is performed under the same condition with Example 1. The composition ratio of the respective elements within the mixture to be the raw material is as follows: La is approximately 7.2 at. %; Fe is approximately 81.7 at. %; Co is approximately 2.8 at. %; and Si is approximately 8.3 at. %.

Figure 3:
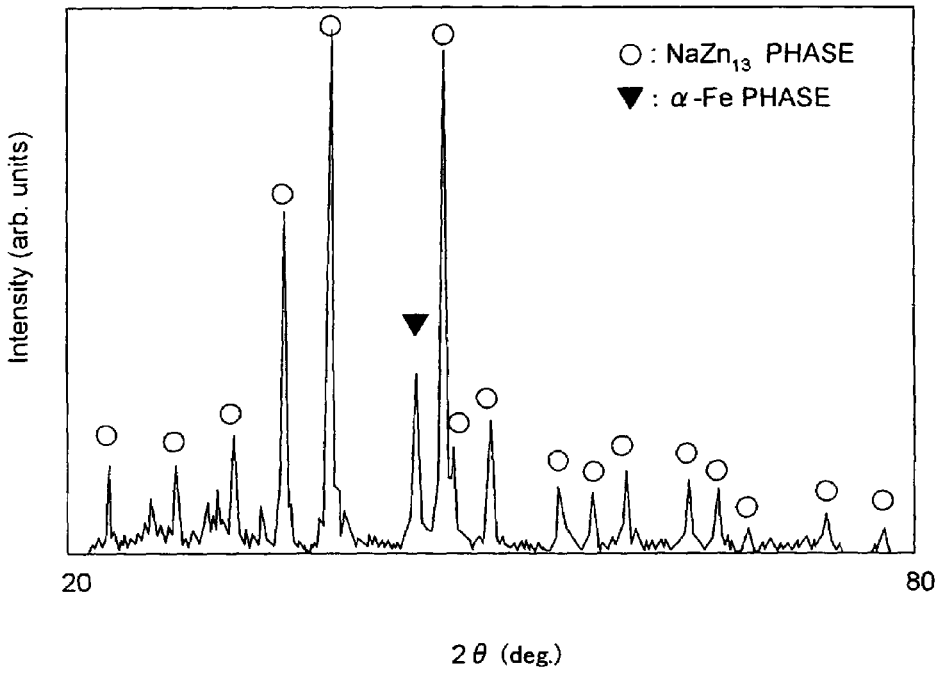
FIG. 3 is a view showing an X-ray diffraction result of a magnetic material according to Example 1 of the present invention.

A powder X-ray diffraction is performed to investigate a constitutional phase of the sintered body of the magnetic material obtained as stated above. An X-ray diffraction result of the magnetic material according to Example 1 is shown in FIG. 3. As it is obvious from FIG. 3, the $NaZn_{13}$ crystal structure phase is generated as a main phase, and a main peak intensity of the $NaZn_{13}$ crystal structure phase is 3.34 times of the main peak intensity of the α-Fe phase.

A generation ratio of the $NaZn_{13}$ crystal structure phase is asked from the powder X-ray diffraction result, and it is confirmed that the $NaZn_{13}$ crystal structure phase exists for 77%. Incidentally, the generation ratio of the $NaZn_{13}$ crystal structure phase is asked by a formula of [main peak intensity of $NaZn_{13}$ phase/(main peak intensity of $NaZn_{13}$ phase + main peak intensity of α-Fe phase)]×100(%). Similar evaluations are performed as for Example 2 and Example 3, and as a result, the generation ratios of the $NaZn_{13}$ crystal structure phases were 75% and 71%.

As stated above, the pressure and the pulse current are simultaneously applied to the elemental powder of the respective elements and the mixture of the compound powder composing the $LaFe_{13}$ based magnetic material, and thereby, it is possible to obtain the magnetic material having the $NaZn_{13}$ crystal structure phase as the same degree as a method in which a heat treatment is performed to a casting alloy for a few days or more, in an extremely short time. Consequently, the manufacturing efficiency of the magnetic material having the $NaZn_{13}$ crystal structure phase can be enhanced.

EXAMPLES 4, 5 AND COMPARATIVE EXAMPLES 1, 2

Samples 1, 2 are created as Comparative Examples 1, 2, and samples 3, 4 are created as Examples 4, 5. The sample 1 as Comparative Example 1 is created by alloying (integrating) the raw material of the respective elements adjusted to be the stoichiometry of $La(Fe_{0.88}Si_{0.12})_{13}$ by an arc melting method. A shape of the sample 1 is a button state with a diameter of 30 mm, and a thickness of 10 mm. The sample 2 as Comparative Example 2 is created by performing a high-frequency melting to the sample 1 under an Ar atmosphere, and quenching this molten metal by using a single-role quenching equipment. The quenching is performed by jetting the molten metal to a Cu roll rotating in a peripheral speed of 30 m/s. A shape of the sample 2 is a thin-band state with an average thickness of 30 μm and a width of 0.9 mm.

The sample 3 as Example 4 is created by grinding the sample 2 into powder with the average particle size of 50 μm or less, and sintering this alloy powder by using the hot press equipment. The sintering is performed for two hours at a temperature of 1000° C. while applying a pressure of 40 MPa to the sample, with the degree of vacuum within the chamber to be 2 Pa. The sample 4 as Example 5 is created by grinding the sample 2 into powder with the average particle size of 50 μm or less, and sintering this alloy powder by using the pulse current pressure sintering equipment. The pulse current pressure sintering is performed by flowing the pulse current with the maximum voltage of 3.0 V, and the maximum current per pressure-receiving area of 480 A/cm$^2$, while applying a pressure of 40 MPa to the sample, with the degree of vacuum within the chamber to be 2 Pa. As the pulse condition, the ON-OFF period of the pulse current is set to be 12-2. The sintering temperature is approximately 1000° C. and the state is kept for three minutes.

Figure 4A:
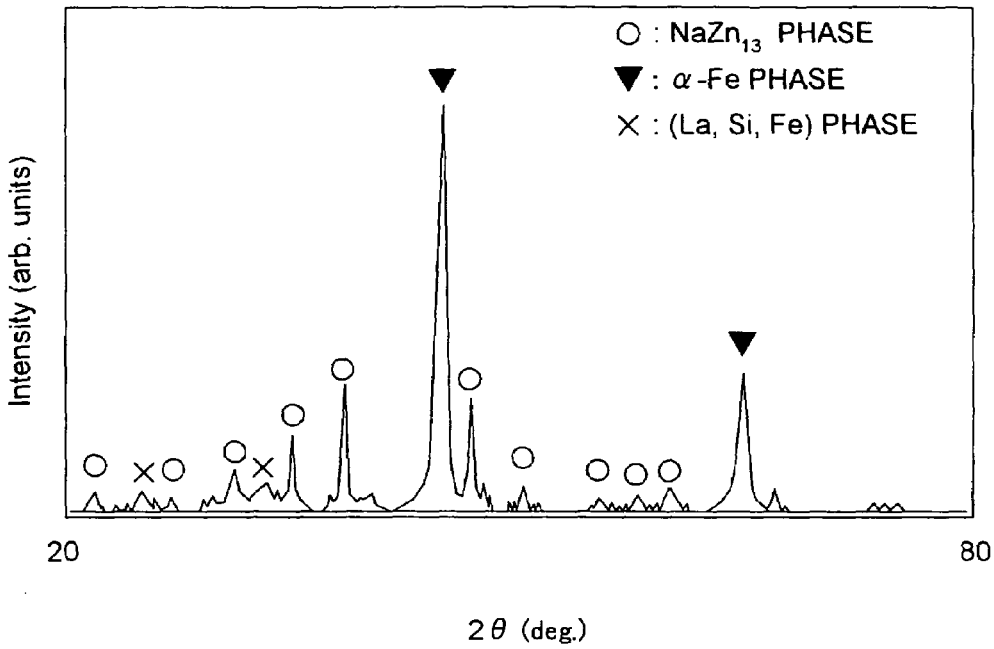
FIG. 4A and FIG. 4B are views showing X-ray diffraction results of magnetic materials according to Comparative Example 1 and Comparative Example 2.
Figure 4B:
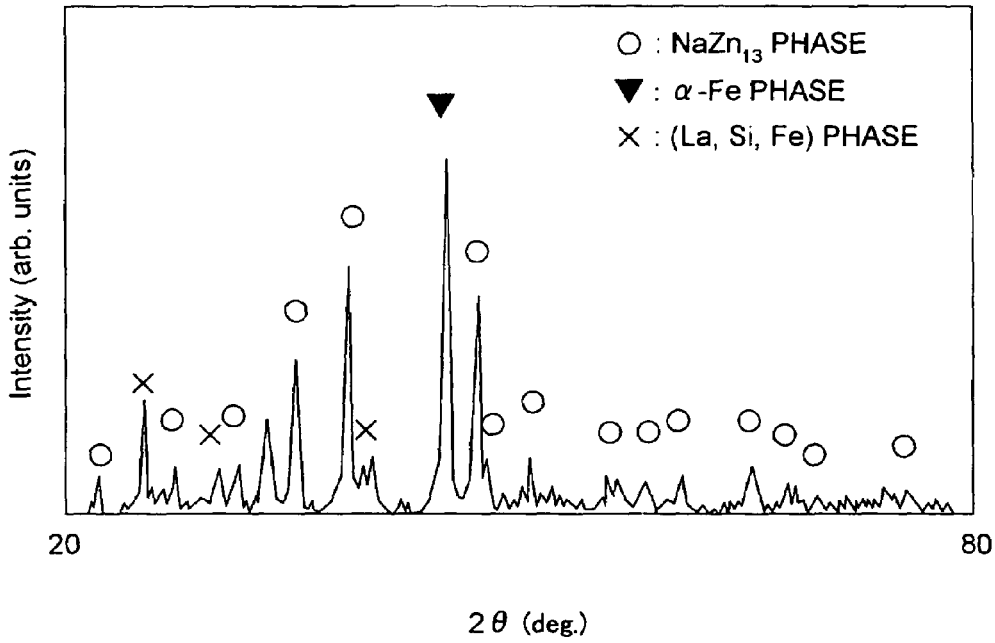
Figure 5A:
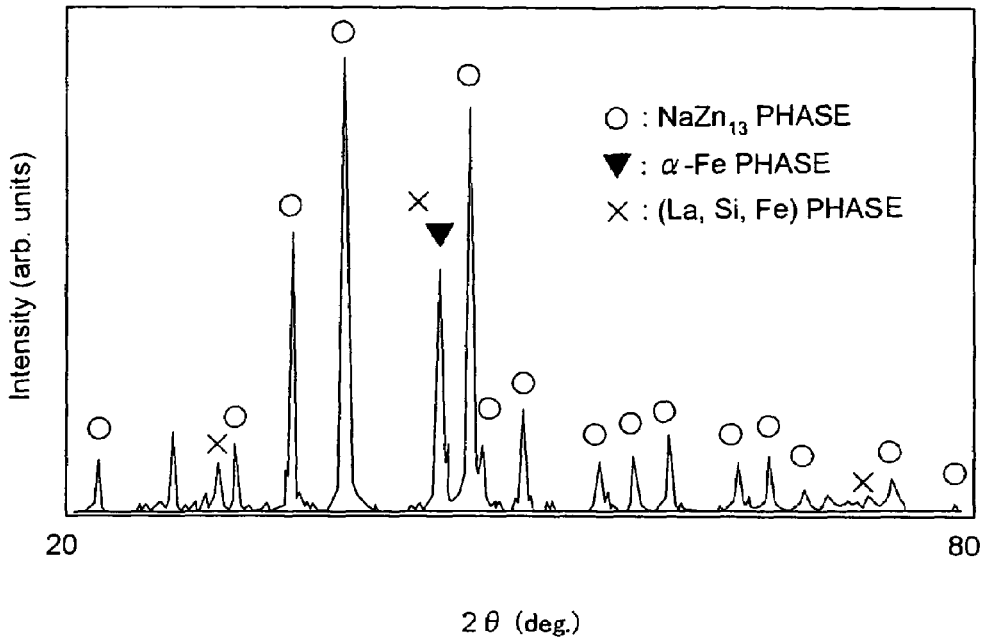
FIG. 5A and FIG. 5B are views showing X-ray diffraction results of magnetic materials according to Example 4 and Example 5 of the present invention.
Figure 5B:
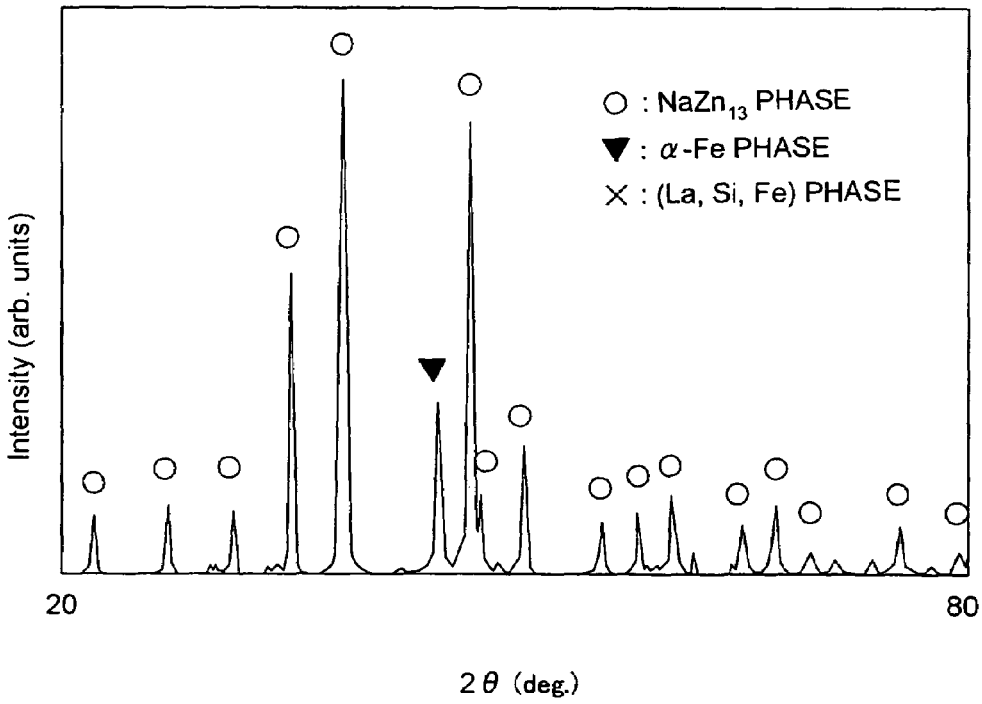

Crystal structure analyses are performed by the X-ray diffraction as for the above-stated samples 1 to 4. The X-ray diffraction results of the samples 1, 2 are shown in FIG. 4A and FIG. 4B. The X-ray diffraction results of the samples 3, 4 are shown in FIG. 5A and FIG. 5B. As shown in FIG. 4A, in the sample 1, the generation of the $NaZn_{13}$ crystal structure phase is seldom confirmed, and the generations of the α-Fe phase and the (La, Si, Fe) phase are confirmed. As shown in FIG. 4B, in the sample 2, the generation of the $NaZn_{13}$ crystal structure phase is increased compared to the sample 1, but a lot of α-Fe phases remain. The generation ratio of the $NaZn_{13}$ crystal structure phase is 40%.

In the sample 3 as Example 4 (FIG. 5A) and the sample 4 as Example 5 (FIG. 5B), extremely a lot of $NaZn_{13}$ crystal structure phases can be seen compared to the samples 1, 2 of the above-stated respective comparative examples. The generation ratios of the $NaZn_{13}$ crystal structure phases in the samples 3, 4 (Examples 4, 5) are 66% and 74%.

As stated above, the molten metal containing the respective elements composing the $LaFe_{13}$ based magnetic material with a predetermined ratio is forcibly cooled, and the alloy powder being disintegrated is applied a pressure and sintered, especially applied the pulse current pressure sintering, to thereby obtain the magnetic material having the $NaZn_{13}$ crystal structure phase as the same degree as a method in which a casting alloy is heat treated for a few days or more, in extremely a short time. Consequently, it becomes possible to drastically increase the manufacturing efficiency of the magnetic material having the $NaZn_{13}$ crystal structure phase. In addition, the alloy which is made to be a thin-band state by the forced cooling is easy to be grinded compared to a massive alloy created by the arc melting method and so on, and therefore, it is advantageous from a point of view of a manufacturing cost.

The results of Examples 1 to 5 and Comparative Examples 1, 2 are shown in a table 1 together.

TABLE 1

| | Material Composition | Heat Treatment | Generation Ratio of $NaZn_{13}$ crystal structure phase (%) | Shape |
|---|---|---|---|---|
| Example 1 | $La(Fe_{0.88}Si_{0.12})_{13}$ | None | 77 | Random |
| Example 2 | $La(Fe_{0.83}Co_{0.05}Si_{0.12})_{13}$ | None | 75 | Random |
| Example 3 | $La(Fe_{0.88}Co_{0.03}Si_{0.09})_{13}$ | None | 71 | Random |
| Example 4 | $La(Fe_{0.88}Si_{0.12})_{13}$ | None | 66 | Random |
| Example 5 | $La(Fe_{0.88}Si_{0.12})_{13}$ | None | 74 | Random |
| Comparative Example 1 | $La(Fe_{0.88}Si_{0.12})_{13}$ | None | 21 | Massive |
| Comparative Example 2 | $La(Fe_{0.88}Si_{0.12})_{13}$ | None | 40 | Thin-band state |

Figure 6:
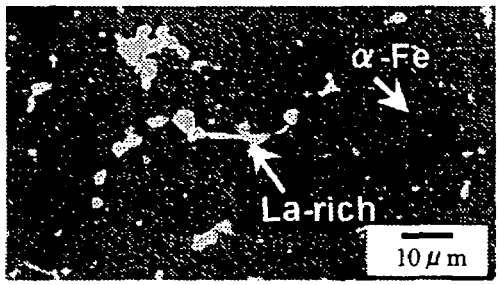
FIG. 6 is an SEM observation image showing a structure of the magnetic material according to Example 1.
Figure 7:
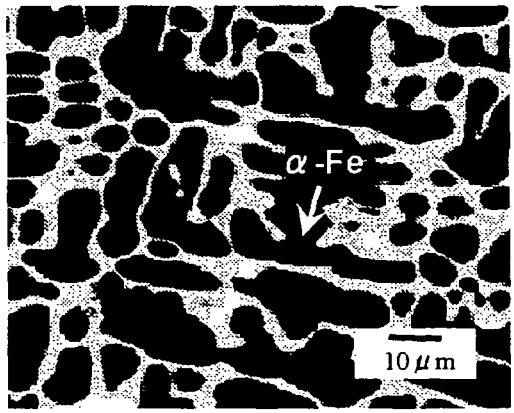
FIG. 7 is an SEM observation image showing a structure of the magnetic material according to Comparative Example 1.
Figure 8:
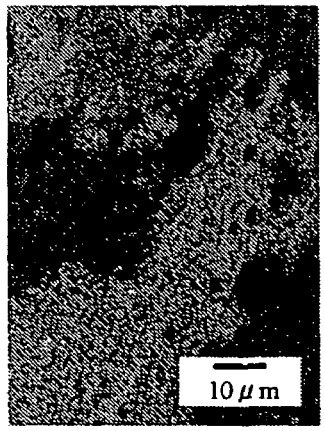
FIG. 8 is an SEM observation image showing a structure of the magnetic material according to Comparative Example 2.

Further, the structures of the respective magnetic materials according to Example 1, Comparative Example 1, and Comparative Example 2 are observed by using an SEM. FIG. 6 is an SEM observation image showing the structure of the magnetic material according to Example 1. FIG. 7 is the SEM observation image of the magnetic material according to Comparative Example 1, and FIG. 8 is the SEM observation image of the magnetic material according to Comparative Example 2. As it is obvious from FIG. 7, a structure in a distinct dendrite state is generated in the magnetic material of Comparative Example 1 created only by the arc melting method, and a major axis thereof is 30 to 50 μm. The magnetic material of Comparative Example 2 (FIG. 8) is composed of a fine metallic structure (particle size of 1 to 2 μm), but the generation ratio of the $NaZn_{13}$ crystal structure phase is low as shown in the table 1.

On the contrary, as shown in FIG. 6, in the magnetic material according to Example 1, a fine and uniform structure is obtained based on the original powder particle size before sintered, even though some aggregated portion can be seen. Further, as shown in the table 1, the generation ratio of the $NaZn_{13}$ crystal structure phase is high. Consequently, it is possible to obtain the magnetic material (sintered body) having the $NaZn_{13}$ crystal structure phase as the main phase, and having a fine and uniform structure. This contributes to improve the manufacturing efficiency and the characteristics of the magnetic material.

Incidentally, the present invention is not limited to the above-stated respective embodiments, but it can be applied to a manufacture of a magnetic material having the $NaZn_{13}$ crystal structure phase. The magnetic material may contain the element R, the element T, and the element M with a predetermined ratio, and such magnetic material and the manufacturing method thereof are also included in the present invention. The embodiments of the present invention can be expanded or modified without departing from the range of the following claims, and the expanded or modified embodiments are to be included therein.

What is claimed is:

1. A manufacturing method of a magnetic material, comprising:

preparing a powder raw material by mixing at least two of powders selected from a powder A, a powder B, a powder C, and a powder D, where the powder A is at least one selected from an elemental powder of element R, and the element R is at least one selected from Y, La, Ce, Pr, Nd, Sm, Eu, Gd, Tb, Dy, Ho, Er, Tm, and Yb, the powder B is at least one selected from an elemental powder of element T, and the element T is at least one selected from Fe, Co, Ni, Mn, and Cr, the powder C is at least one selected from an elemental powder of element M, and the element M is at least one selected from Si, B, C, Ge, Al, Ga, and In, and the powder D is at least one selected from compound powders composed of at least two of elements among the element R, the element T, and the element M; and forming a sintered body of the magnetic material having an $NaZn_{13}$ crystal structure phase by heating the powder raw material while applying a pressure.

2. The manufacturing method according to claim 1, wherein the powder raw material comprises the element R in a range of not less than 4 atom percent nor more than 15 atom percent, the element T in a range of not less than 60 atom percent nor more than 93 atom percent, and the element M in a range of not less than 3 atom percent nor more than 25 atom percent.

3. The manufacturing method according to claim 1, wherein the powder raw material comprises La in a range of not less than 5 atom percent nor more than 10 atom percent as the element R, Fe in a range of not less than 70 atom percent nor more than 91 atom percent as the element T, and Si in a range of not less than 4 atom percent nor more than 20 atom percent as the element M.

4. The manufacturing method according to claim 3, wherein the powder raw material comprises Fe of 79 atom percent or more.

5. The manufacturing method according to claim 3, wherein the powder raw material further comprises Co in a range of not less than 0.5 atom percent nor more than 15 atom percent as the element T.

6. The manufacturing method according to claim 1, wherein the powder D comprises at least one selected from $La_5Si_3$, $La_3Si_2$, LaSi, and $LaSi_2$.

7. The manufacturing method according to claim 1, wherein the powder raw material is heated by applying a current.

8. The manufacturing method according to claim 1, wherein the forming the sintered body comprises applying the pressure and a pulse current simultaneously to the powder raw material.

9. The manufacturing method according to claim 1, wherein the powder A, the powder B, the powder C, and the powder D have average particle sizes of 50 μm or less.

10. The manufacturing method according to claim 1, wherein the powder A, the powder B, the powder C, and the powder D have the average particle sizes of 20 μm or less.

11. The manufacturing method according to claim 1, wherein an oxygen content of the magnetic material is less than 2 atom percent.

12. The manufacturing method according to claim 1, wherein an oxygen content of the magnetic material is less than 0.2 atom percent.

13. The manufacturing method according to claim 1, wherein the magnetic material comprises a hydrogen content not less than 2 atom percent nor more than 22 atom percent.

14. The manufacturing method according to claim 2, wherein the powder raw material comprises the element T in a range of not less than 70 atom percent nor more than 91 atom percent.

15. The manufacturing method according to claim 2, wherein the powder raw material comprises the element M in a range of not less than 4 atom percent nor more than 20 atom percent.

16. The manufacturing method according to claim 7, wherein the applied current is a pulse current.

17. The manufacturing method according to claim 8, wherein the pressure is applied under a vacuum condition.

18. The manufacturing method according to claim 8, wherein the pressure is applied under an inert gas condition.

19. The manufacturing method according to claim 8, wherein the applied pressure is in a range of 5 MPa and 100 MPa.

20. The manufacturing method according to claim 8, wherein the sintering temperature is in a range of 800 and 1400° C.

* * * * *